United States Patent [19]

Puckhaber et al.

[11] Patent Number: 4,794,706

[45] Date of Patent: Jan. 3, 1989

[54] DYNAMIC TRANSVERSE GIRTH

[75] Inventors: John H. Puckhaber, Green Brook; Kenneth W. Misevich, Piscataway; Thomas E. Mintel, Somerset, all of N.J.

[73] Assignee: Colgate-Palmolive Company, Piscataway, N.J.

[21] Appl. No.: 80,950

[22] Filed: Aug. 3, 1987

[51] Int. Cl.[4] ..... A43B 07/14

[52] U.S. Cl. ..... 36/91; 36/50; 128/611

[58] Field of Search ..... 36/88, 91, 97, 50, 58.5, 36/119, 114; 128/80 D, 611

[56] References Cited

U.S. PATENT DOCUMENTS

| | | | |
|---|---|---|---|
| 1,286,787 | 12/1918 | Rokahr | 36/91 |
| 2,530,637 | 11/1950 | Taylor | 128/611 |
| 4,166,329 | 9/1979 | Herbig | 36/97 |
| 4,476,639 | 10/1984 | Zaccaria | 36/50 |
| 4,550,511 | 11/1985 | Gamm | 36/91 |
| 4,592,154 | 6/1986 | Oatman | 36/50 |

FOREIGN PATENT DOCUMENTS

| | | | |
|---|---|---|---|
| 1258562 | 3/1961 | France | 36/114 |
| WO85/03207 | 8/1985 | PCT Int'l Appl. | 36/119 |

*Primary Examiner*—Steven N. Meyers

*Attorney, Agent, or Firm*—Murray M. Grill; Richard J. Ancel

[57] ABSTRACT

A shoe construction for providing girthing support to the midfoot region of the foot is disclosed. The present invention provides for adjusting the perimeter of the transverse girth of a shoe in the midfoot region under varying conditions of loading. When the foot is in an unloaded condition, the dynamic girth of the present invention has no effect on the original girthing tension. Then as the foot is loaded and everted, girthing fibers or straps are forced into an undulating surface. When the everted foot becomes loaded completely, the girthing straps become mated with the undulating surface in close contiguous contact, thus pulling in the girth straps and producing maximum tension on the midfoot region. The undulating surface may be provided in the outsole so as to be positioned below the girthing straps or, alternatively, in a portion of the shoe positioned above the girthing straps. The girth structure of the present invention creates girthing tension dynamically to prevent excessive eversion when the foot loads the shoe.

28 Claims, 3 Drawing Sheets

FIG. 1
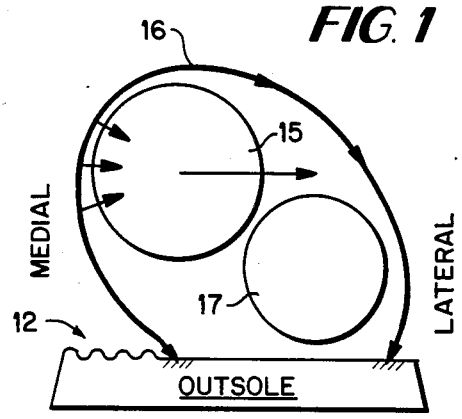
FIG. 2
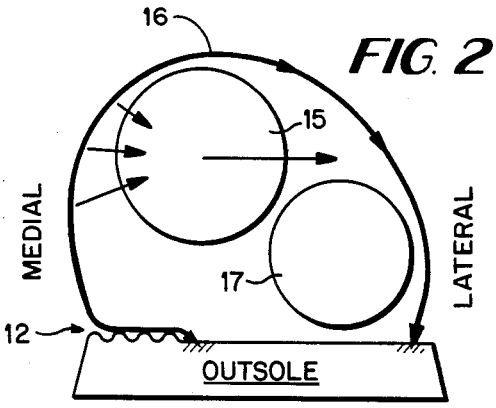
FIG. 3
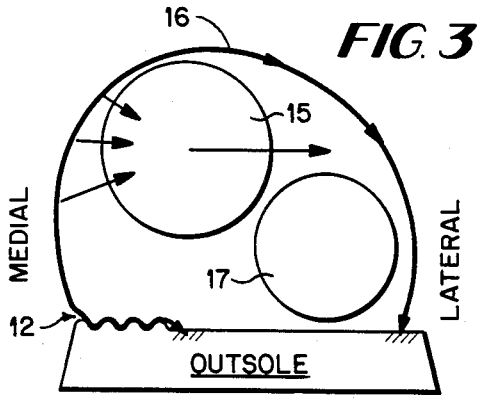
FIG. 4
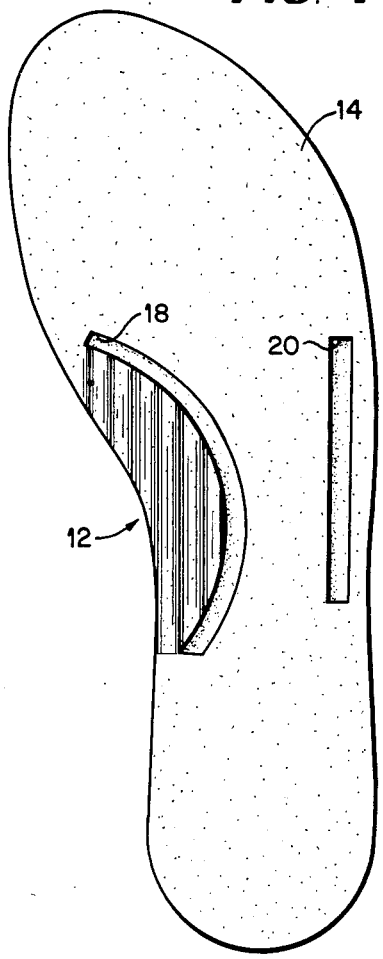
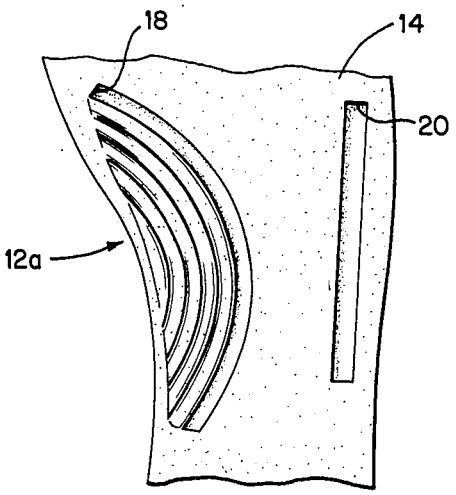
FIG. 5

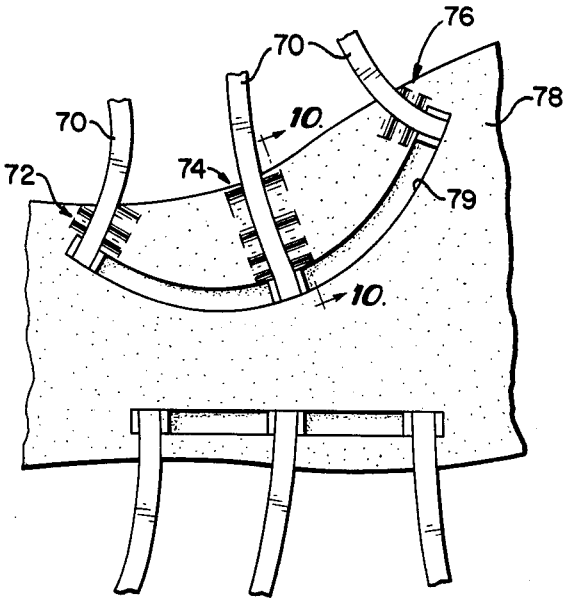
FIG. 9
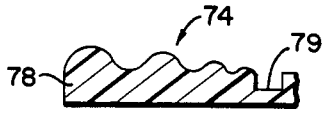
FIG. 10
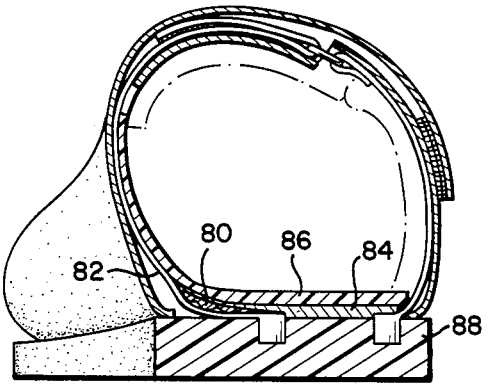
FIG. 11
FIG. 12
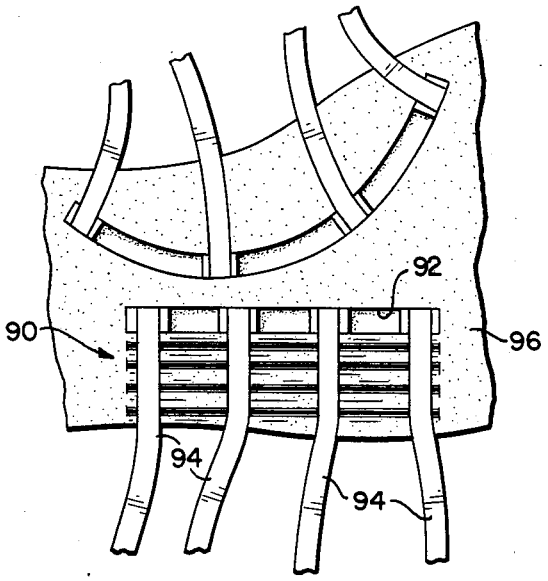

DYNAMIC TRANSVERSE GIRTH

BACKGROUND AND SUMMARY OF THE INVENTION

The present invention relates to a device for supporting the medial arch of the foot. More particularly, the present invention relates to a device for adjusting the perimeter of the transverse girth of a shoe in the midfoot region under varying conditions of loading. The effective volume of the midfoot area of the shoe is dynamically varied by the present invention to prevent the foot from everting and to provide different levels of support during the gait cycle.

In an attempt to understand the foot as a system, the various parameters which affect the function of the foot have been studied, particularly with regard to a weight bearing foot. The practical need for such knowledge lies in the fact that a true structural model of the foot is capable of providing a prediction of gait and the effects of a shoe on gait. By knowing, in advance, how a shoe would affect the performance of an athlete, for example, optimum shoes could be designed without the usual "cut and try" method of standard shoe development.

The traditional model of the foot provides for a one column, two-axis model which maintains that the foot under load is a rigid structure with a talocrural (ankle) axis and an apparent subtalar axis. The front of the foot is relatively rigid, but with only a multitude of small bone movements about the midtarses axes. The average direction of the effective axis under the ankle, called the subtalar axis, is said to be 42 degrees vertical and 16 degrees horizontal to the midline of the body, as measured by Inman, V. T., *The Joints of the Ankle,* The Williams & Wilkins Co., Baltimore, 1976. However, this theory does not hold up with regard to a weight bearing or loaded foot since, if the force due to body weight were to act on the single traditional subtalar axis, the foot would collapse mechanically.

It has now been determined that the foot is comprised of two columns and three axes. The lower, lateral column is basically a rigid base comprised of the Calcaneus, Cuboid, and the fourth and fifth metatarsals. The remainder of the foot, which is comprised of the navicular, the first, second and third cuneiforms and the first, second and third metatarsals, emanates from the talus at the talonavicular interface swinging in combination with the lower column inversion/eversion actions in what may be called the 'subtalar joint axis'. But this articulation of what is called the upper foot column is only secondary to the true foot mechanism. The primary mechanical loading interface is on the lower, lateral column at the rear of the talus onto the calcaneus, the posterior talocalcaneal facet.

It has also been determined that the foot operates differently under load than when it is passively manipulated such as a doctor would do in the office. This distinction helps to explain previous misconceptions as to how the foot works under load.

This new understanding has yielded a new structural model of the foot which has two separate columns, wrapped together with fascia, and three nearly orthogonal axes. The three axes are: (1) the talocrural (ankle) axis; (2) the talocalcaneal axis (formed at the facet between the talus and the calcaneus); and (3) the talonavicular axis (formed at the facet between the talus and the navicular bones).

Generally, shoes are laced or strapped with no load on the foot until the wearer subjectively feels sufficient tension. Upon loading of the foot such as while walking or running, the girth stretches and the knots tighten. This loosens the girthing tension by an amount which cannot be predicted in advance.

By the present invention there is provided an improved girthing support which allows the creation of a supportive girthing when the foot everts and loads the region of the medial arch. The girthing support of the invention then relaxes when the foot is standing on the lateral border or is unloaded. The present invention allows the degree to which the girth is tightened and loosened while wearing the shoe to be accurately predicted in advance.

In accordance with the present invention, when the foot is in an unloaded condition, the dynamic girth construction of the present invention has no effect on the original girthing tension. Then as the foot is loaded and everted, the girthing fibers are forced into an undulating surface. This reduces the effective length of the fibers and begins to tighten the girth. When the everted foot becomes loaded completely, the girthing fibers are mated with the undulating surface in close contiguous contact, thus pulling in the girth fibers and providing maximum tension on the midfoot region of the foot.

Accordingly, it is a primary object of the present invention to provide a girth structure which will create girthing tension dynamically to prevent excessive eversion when the foot loads the shoe.

An additional object of the invention is to provide a girthing structure which will advantageously interact with the dynamics of the foot while wearing the shoe during walking, running and other activities.

A further object of the invention is to provide a girthing action which will increase the circulation of blood in the feet and assist the heart in the movement of blood in the lower extremities.

BRIEF DESCRIPTION OF THE DRAWINGS

FIG. 1 is a diagram showing a posterior view of a right foot in cross section of midfoot girthing in a shoe construction of the present invention under no load conditions, wherein the foot subject to girthing is represented as having two columns, an upper, medial column and a lower, lateral column.

FIG. 2 is a diagram showing a posterior view similar to FIG. 1 but under partial load conditions.

FIG. 3 is a diagram showing a posterior view similar to FIG. 1 but under full load conditions.

FIG. 4 is a top plan view of a first embodiment of an outsole of the present invention.

FIG. 5 is a partial top plan view of a second embodiment of an outsole of the present invention.

FIG. 9 is a top plan view of an outsole showing another embodiment of the invention.

FIG. 10 is a sectional view taken along line 10—10 of FIG. 9.

FIG. 11 is a sectional view of a shoe incorporating a further embodiment of the invention.

FIG. 12 is a top plan view of an outsole showing another embodiment of the invention.

DESCRIPTION OF THE PREFERRED EMBODIMENTS

Figure 6:
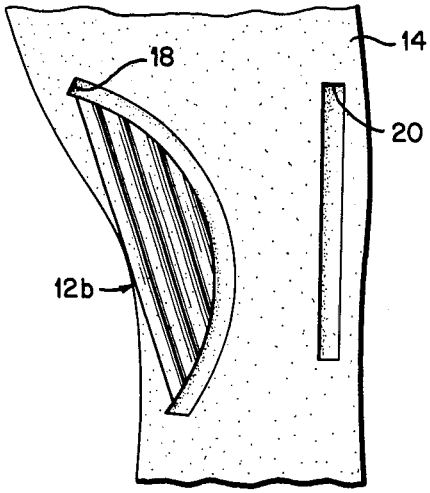
FIG. 6 is a partial top plan view of a third embodiment of an outsole of the present invention.

In the embodiments of the invention as shown in FIGS. 1 through 7, there is provided a dynamic transverse girth structure 10 which includes an undulating surface 12 provided in the upper surface on the medial side of the outsole 14 of a shoe.

In FIGS. 1 through 3, there is shown a sequence in which the foot becomes progressively more loaded. The upper, medial column 15 and lower, lateral column 17 of the foot are shown in their positions relative to the outsole and the sling straps 16. In FIG.1, one or more sling straps 16 in the midfoot region of a shoe are shown diagrammatically as having no engagement with the undulating surface 12 when the foot is in the unloaded condition. As evidenced by the drawings, the midfoot region includes that portion of the foot posterior to the first metatarsal head and anterior to the calcaneus. In FIG. 2, which shows the shoe construction under a partial load, the sling straps 16 have begun to be forced into the undulating surface 12 so that the effective length of the straps 16 is reduced. Finally, in FIG. 3, the foot is fully loaded and the sling straps 16 are mated with the undulating surface in close contiguous contact, thus providing maximum tension on the straps 16.

The reduction in girth length when the foot is fully loaded is equal to the line integral of the undulating surface minus the length of the undulations in the direction of undulation or wave propagation (s-l) where:

$$y = f(x); \text{ and } s = \int_0^l \sqrt{1 + (dy/dx)^2}\, dx$$

wherein y is the amplitude of the undulations and x represents distance perpendicular to y in the direction of wave propagation.

In FIG. 4 there is shown an outsole 14 which may be employed with the present invention, the outsole 14 having a medial slot 18 and a lateral slot 20 in the midfoot region. These slots 18 and 20 are for the purpose of receiving sling straps which are mounted therein. In one embodiment, each of the slots 18, 20 is of sufficient depth to allow the respective slot to receive one end of the sling straps and maintain the connection of the straps at or below the level of the top of the outsole. Both slots 18, 20 are positioned in the upper surface of the outsole 14 so as to lie beneath the foot of the wearer. In FIG. 4 the undulating surface 12 is shown with the axis of the undulations 12 extending generally parallel to the longitudinal axis of the outsole 14.

In one embodiment, the medial slot 18 of the outsole 14 is in the form of an arcuate shape which lies beneath three anatomical points of the foot: (1) the posterior edge of the first metatarsal head; (2) the second or third cuneiform, preferably the third cuneiform; and (3) the medial side of the calcaneus. It is noted that a smooth arcuate shape is only relevant to a smooth groove in the outsole, whereas individual anchor points would align to the direction of the strap.

In one embodiment, the lateral slot 20 of the outsole 14 lies under the lower column of the foot throughout the length of the slot. This slot which is generally linear thus extends from the posterior edge of the fifth metatarsal head to a position proximate and adjacent the calcaneal-cuboid joint.

The specific shape, location and construction of the medial and lateral slots may be varied. It is also within the scope of the invention for an end portion of each of the sling straps to be adhered or otherwise attached to the upper surface of the outsole without the use of slots. The straps are each capable of serving as separate and independent lines of force to prevent the foot from everting and to provide the necessary support.

With regard to the relationship of each sling strap to the undulating surface, in the preferred embodiment, the direction of each strap upon making contact with the undulating surface will be parallel to the direction of undulation or wave propagation, regardless of the position of a particular sling strap on the outsole. Thus the direction of each strap will be perpendicular to the contour of the wave.

FIGS. 4, 5 and 6 show various arrangements of the undulations relative to one embodiment of the medial 18 and lateral 20 slots.

In FIG. 4, the undulations 12 in this embodiment extend from the anterior end of the medial slot 18 in a direction generally parallel to the longitudinal axis of the outsole 14, terminating at the medial edge of the outsole 14. Thus the direction of undulation or wave propagation is generally transverse to the longitudinal axis. The undulations 12 extend in a posterior direction and terminate at a line which extends transversely from the posterior end of the medial slot 18 to the medial edge of the outsole 14.

In FIGS. 5 and 6 there are shown alternative embodiments of the undulation configuration. The embodiment of FIG. 5 has the undulations **12*a* provided as a series of arcuate undulations which are concentric with the medial slot 18. The embodiment of FIG. 6 has the undulations 12*b* provided as a series of parallel undulations with the undulation 12*b* on the extreme medial side extending between the anterior and posterior ends of the medial slot 18. The remaining undulations 12*b*** are parallel to the undulation on the extreme medial side.

It is within the scope of the present invention for the wavelength of the undulations as well as the amplitude thereof to vary throughout the extent of such undulations. Thus, for example, in the embodiment of FIG. 4, the wavelength and the amplitude of the undulations could vary along the length of the medial slot. In the embodiment of FIG. 5, the wavelength and amplitude of the undulations could vary from one concentric arc to the next while in the embodiment of FIG. 6, the wavelength and amplitude of the undulations could vary from one parallel undulation to the next. These are examples of the feature of the present invention whereby the amount by which the girth straps are shortened can be varied throughout the midfoot region. In this manner, for example, an embodiment of the invention can be provided in which either or both the wavelength and the amplitude are gradually increased and then decreased across the midfoot region.

Figure 7:
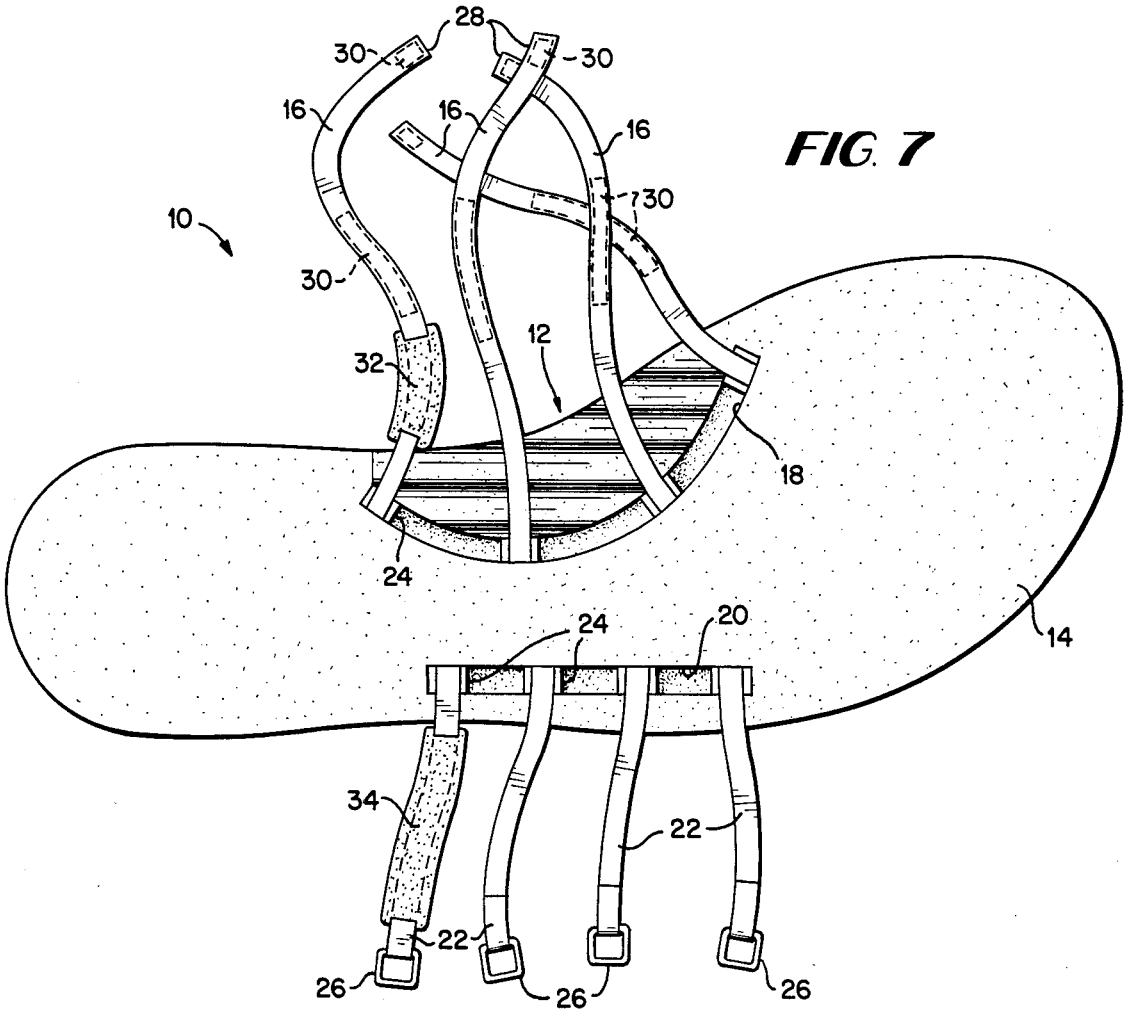
FIG. 7 is a top plan view of an outsole with sling straps in accordance with the present invention.

In the embodiment of the invention as shown in FIG. 7, there is shown an embodiment of the dynamic transverse girth 10 of the present invention in which a plurality of sling straps 16 on the medial side of the foot are positioned with one end of each strap 16 secured in arcuate medial slot 18 of outsole 14. A corresponding plurality of sling straps 22 on the lateral side are positioned with one end of each strap 22 secured in lateral slot 20. The straps 16, 22 are secured by means of tabs 24 which are individually attached to the inner end of each sling strap 16, 22 and then secured by adhesive or other means within the respective slot 18, 20, with the tabs 24 being of a size which will not extend above the top of the outsole 14 and which allows the inner end of each strap 16, 22 to lie smoothly along the upper surface of the outsole 14. In securing the straps 16, 22, the medial strap 16 passes through a buckle 26 fastened at the upper end of the corresponding lateral strap 22. The medial strap 16 is then folded back so that its outer end 28 may be secured to the outer surface of a portion of the strap 16 itself by means such as hook and pile retention means, generally identified in the trade as a Velcro attachment 30. Suitable pad members 32, 34 may be secured to the underside of respective straps 16, 22 to provide comfort in certain contact areas of the straps 16, 22 with the foot. Cushioning may be provided in the arch section of the insole for added comfort.

In the embodiment of FIG. 7, the medial attachment points in the medial slot approximately form an arc under the arch. A plurality of distinct sling straps should fan out into this medial arc. The sling straps must be strong and relatively inextensible, and, very importantly, they must be capable of being adjusted for length independent of one another. The sling straps on both the medial and lateral sides of the foot should not have a stiff covering or be adhered to a stiff upper which would interfere with the independent adjustment of the straps.

The term "relatively inextensible" should be defined for the purposes of the present invention. Conventional shoe laces are typically woven structures in which fiber alignment provides that large strains must be produced before a significant load can be handled. One typical shoe lace strained 5% but carried a load of only five pounds. While a shoe lace has a continually increasing modulus, it is more beneficial, with regard to the present invention, for the support sling fibers to have a significant initial modulus which remains linear throughout the effective support range. Such a property allows significant forces to be supported at much lower strains. This is the inextensibility required for the support sling straps of the present invention.

The sling straps employed in the present invention could be any of various constructions, such as a flat strap of narrow width or a monofilament material with cushioning material underneath to protect the foot tissue. If the straps are too wide, however, they will tend to lift off the foot at certain points, thus creating excessive local pressures on the foot and failing to provide the proper support. Wide inextensible straps will have directionality problems and will cause local pressure points. Wide straps also take away from the ability to adjust the straps properly. As an example of a strap which may be employed in the present invention, a polyester ribbon strap having a width of about ⅜ inch and a modulus of about 525 pounds per inch per inch has been used with good results. At least five medial and five lateral straps of this type were employed in one embodiment and the overall contact area for the Velcro fasteners of the straps was approximately 2½ square inches. In this embodiment, a polyurethane outsole having a thickness of about ½ inch and a Shore A hardness of about 50 durometer was employed.

It is also within the scope of the present invention for each of the straps to have a separate undulation which regulates the change in dimensioning for that strap. Thus, in the embodiment as shown in FIGS. 9 and 10, each of the medial straps 70 is provided with a separate undulating surface 72, 74, 76, in the outsole 78 with the surfaces 72, 74, 76 extending from medial slot 79 to the medial edge of the outsole 78. The direction of each strap 70 is perpendicular to the contour of the respective undulation or wave. By varying the wavelength and/or the amplitude of each of the undulations 72, 74, 76, each strap 70 may be shortened by a different amount as the foot is loaded. In addition, each of the surfaces 72, 74, 76 may have the undulations varied in wavelength and amplitude throughout the extent of a particular surface. In the embodiment of FIG. 10, the amplitude of undulating surface 74 is at a minimum adjacent the medial slot 79, and the amplitude is gradually increased from the minimum to a maximum value at the extreme medial end of surface 74. By the use of such a construction, as the foot progresses toward eversion, a larger percentage of force is progressively applied. Initially, a small amount of restoring force is applied to restore the foot to a stable position, with a progressively greater force being applied as the foot reaches a position of greater instability.

Figure 8:
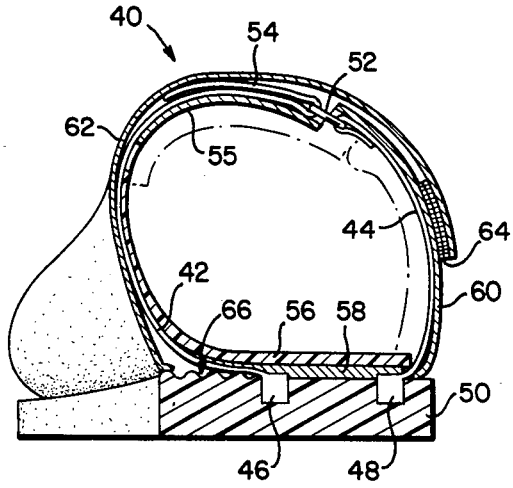
FIG. 8 is a sectional view of a shoe incorporating the dynamic transverse girth of the present invention.

In FIG. 8 there is shown a shoe upper 40 having the dynamic transverse girth of the invention installed therein. As shown in FIG. 8, the medial 42 and lateral 44 sling straps extend up and over the foot from their points of attachment to respective tabs 46, 48 embedded in outsole 50. Medial strap 42 passes through a buckle 52 fastened at the upper end of the corresponding lateral strap 44. The medial strap 42 is then folded back so that its outer end 54 may be secured to the outer surface of a portion of the strap 42 itself by means such as a Velcro attachment 55.

An insole and inner liner member 56 is secured to the insole base 58 which itself is secured over the tab and sling strap connection to the outsole 50. The upper 40 is provided with an inner 60 and outer 62 flap at the midfoot region. These flaps 60, 62 may be releasably secured to each other by any suitable means such as a Velcro attachment 64. As shown in FIG. 8, the inner flap 60 may be continued across the vamp of the shoe. The undulations 66 are provided on the medial side of the upper surface of the outsole 50 in the midfoot region as previously discussed. The flap 62 is attached to the extreme medial portion of the upper surface of the outsole 50 so as not to interfere in the engagement of the medial straps 42 with the undulations 66.

In FIG. 11, there is shown an embodiment of the invention in which a mating undulating surface 80 is provided for engagement with the upper surface of the medial strap 82. The undulating surface 80 may be incorporated into a medial portion of the insole base 84 as shown or form part of the insole and inner liner member 86 on the medial side thereof. In either case, the undulating surface 80 should be located below the foot so as to shorten the strap 82 when the foot is loaded. It is within the scope of the invention for the undulating surface 80 to be located so as to mesh only with the upper surface of the strap 82, or only with the lower surface of the strap 82 as when the undulating surface is incorporated in the outsole 88, or for matched undulating surfaces to be located so as to mesh with both the upper and lower surfaces of the strap 82. Although only one strap 82 is shown in FIG. 11, it is of course to be understood that a plurality of such medial straps 82 may be employed.

In order to shorten a girth strap, it is necessary for a conforming surface to be provided on the opposite side of the strap from the undulating surface. When the undulating surface is provided below the girth strap, as shown in FIG. 8, soft tissue of the foot will provide the necessary conforming surface, with no additional non-conforming material being present between the strap and the soft tissue. In the case of a board lasted shoe, the portion of the board above the undulating surface must be removed. When the undulating surface is located above the girth strap, as shown in FIG. 11, a conforming surface must be provided immediately below the strap. The conforming surface may be provided by the outsole, if the outsole is of a sufficiently soft, pliable material such as soft polyurethane. Alternatively, an additional layer of conforming material can be attached to the shoe between the strap and the outsole.

In the embodiment of FIG. 12, undulations 90 are provided under the lower column of the foot, with the lateral slot 92 being located medially of the lower column. Thus the lateral straps 94 will engage the undulating surface 90 in the outsole 96. Such an embodiment could be helpful in relieving tension, for example, when a person is sitting. In a manner similar to the embodiment of FIG. 11, the undulations 90 could also be provided either above or below the straps 94, or both above and below such straps 94. The amplitude and wavelength of these undulations 90 may also be varied.

In one embodiment of the present invention, the construction and location of the sling straps is specified according to recognized anatomical landmarks. In this embodiment, the anterior lateral strap must be posterior to the fifth metatarsal head. Also, the posterior lateral strap should pass across the foot proximate and adjacent the calcaneal-cuboid joint. The anterior medial strap must remain posterior to the first metatarsal head in this embodiment. The posterior medial strap must be directed posteriorly, after passing proximate and adjacent the navicular protuberance. The medial and lateral slots are of sufficient length to allow the straps to attain these anatomical positions. One or more additional straps, as desired, are spaced between the anterior and posterior straps on each side of the outsole.

The closure device for the sling straps may be of any conventional type which is relatively inextensible so as to provide a small degree of looseness upon first tightening the straps with minimal or no load on the foot.

Since it is not desirable to have a continuously tight girth for reasons of circulation and comfort, the girthing straps should be relatively inextensible and at some minimum tension when the foot is not loaded. In order to tighten the straps dynamically, the straps must be effectively shortened as the load is applied. This occurs during loading of the foot, as it has been determined that the average midfoot expands approximately ¼ inch circumferentially when fully loaded. The relatively inextensible characteristic of the straps acts to prevent the foot from everting upon loading.

As an example of a reduction in girth length which will provide a maximum reduction of ¼ inch, utilizing the formula previously described, for a shoe having 3.5 sinusoidal undulations extending over a distance of ¾ inch, the amplitude was calculated to be approximately 0.045 inch.

The strap geometry and specific mechanical properties can be varied as long as minimum strength and stiffness of the sling straps are maintained without introducing local pressures to the foot.

In one embodiment, the hoop which includes the medial and lateral straps and the portion of the outsole between the medial and lateral anchor points should not strain or elongate more than about 10% under body loads of the order of two to three body weights as occur during the walking/running gait cycle. Generally, the greatest strap loadings will occur during action involving maximum loads on the medial border. During running, strap loadings would be carried during the gait cycle first by the rear straps and then would move forward during the midstance of the gait cycle. The act of standing would tend to distribute the loads more evenly.

The methods of maintaining the relative positions of the straps may be varied, for example, by bonds to the upper fabric and/or some additional scrim cloth.

The present invention shortens the girthing straps by the action of the foot, forcing the straps into a hard undulating surface which is part of the outsole. The increased length required to mate with the outsole surface effectively shortens the remainder of the girthing hoop surrounding the foot. In one embodiment, these straps have a soft resilient layer of a foam or elastomer between them and the foot to relieve pressure points on the surface of the foot. The undulating surface is provided under the medial arch and outside of the sling strap anchor points. The strength and surface of the strap, along with the smoothness and low friction of the surface, are essential for durability. The undulations can be of any smooth wave form that will reduce the girthing hoop by the desired length when the foot is fully loaded.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A shoe construction for providing girthing support to the midfoot region of the foot wherein said midfoot region includes that portion of the foot posterior to the first metatarsal head and anterior to the calcaneus, comprising: a shoe member having a medial side and a lateral side; at least one girthing strap for securing the foot to said shoe member, said girthing strap having an effective length along the longitudinal axis thereof and being attached to said shoe member at a position below the midfoot region of the foot; and means for providing an undulating surface for engagement by said strap so that said strap is forced to conform to the undulating surface upon loading of the midfoot region of the foot, whereby the effective length of said girthing strap is reduced.

2. The shoe construction of claim 1 wherein said shoe member includes an outsole and wherein said undulating surface is provided in the upper surface of said outsole.

3. The shoe construction of claim 2 wherein said undulating surface is provided on the medial side of said outsole.

4. The shoe construction of claim 2 wherein said undulating surface is provided on the lateral side of said outsole.

5. The shoe construction of claim 1, further including a shoe portion with lower surface, said shoe portion being attached to said shoe member and positioned above the top surface of a portion of said strap, and wherein the lower surface of said show portion is provided with an undulating surface portion for engagement with said top surface of said strap.

6. The shoe construction of claim 5 wherein said shoe portion is an insole base.

7. The shoe constriction of claim 1 wherein the direction of said girthing strap is perpendicular to the contour of said undulating surface.

8. The shoe construction of claim 1 wherein said girthing strap has means for releasably securing said strap about the midfoot region of the foot.

9. The shoe construction of claim 1 wherein the reduction in girth length of said strap is equal to "s", the line integral of the undulating surface minus "1", the length of the undulations in the direction of undulation or wave propagation (s-1) where:

$$y = f(x); \text{ and } s = \int_0^l \sqrt{1 + (dy/dx)^2}\, dx$$

wherein y is the amplitude of the undulations and x represents distance perpendicular to y in the direction of wave propagation.

10. The shoe construction of claim 1 wherein said girthing strap has at least one end thereof secured to the upper surface of said shoe member.

11. The shoe construction of claim 10 wherein said girthing strap has one end secured to said shoe member adjacent the medial side of the shoe member and another end secured adjacent the lateral side of the shoe member.

12. The shoe construction of claim 1 wherein a plurality of girthing straps are employed, each girthing strap having one end secured adjacent the medial side of said shoe member and another end secured adjacent the lateral side of said shoe member.

13. The shoe construction of claim 1 wherein said girthing strap is secured to said shoe member at a position below the upper column of the foot, said upper column of the foot being defined as including th navicular, the first, second and third cuneiforms and the first, second and third metatarsals.

14. The shoe construction of claim 13 wherein said position below the upper column of the foot is defined by an arc which lies beneath three anatomical points of the foot, said points including the posterior edge of the first metatarsal head, the second or third cuneiform and the medial side of the calcaneus.

15. The shoe construction of claim 1 wherein said girthing strap is secured to said shoe member at a position so as to pass beneath the lower column of the foot, said lower column of the foot being defined as being in the form of a base which includes the calcaneus, cuboid and fourth and fifth metatarsals.

16. The shoe construction of claim 1 wherein said undulating surface has a wave-like construction in which the direction of wave propagation is generally perpendicular to the longitudinal axis of the shoe.

17. The shoe construction of claim 1 wherein said undulating surface extends from the outer medial surface of the shoe member to a position under the medial arch.

18. The shoe construction of claim 1 wherein said shoe member has a medial slot located in the upper surface of said shoe member and wherein said girthing strap is mounted in said slot, said slot being formed so as to lie beneath three anatomical points of the foot, said points including the posterior edge of the first metatarsal head, the second or third cuneiform and the medial side of the calcaneus.

19. The shoe construction of claim 18 wherein a plurality of undulations are provided on the medial side of said shoe member, said undulations being concentric with said medial slot.

20. The shoe construction of claim 18 wherein a plurality of undulations are provided on the medial side of said shoe member, said undulations being aligned in parallel relation with the undulation on the extreme medial side extending between the anterior and posterior ends of the medial slot.

21. The shoe construction of claim 1 wherein said shoe member has a lateral slot located in the upper surface of said shoe member and wherein said girthing strap is mounted in said slot, said slot being formed so as to lie beneath a line which extends from the posterior edge of the fifth metatarsal head to a position proximate and adjacent the calcaneal-cuboid joint.

22. The shoe construction of claim 1 wherein a plurality of undulations are employed and wherein the wavelength of the undulations varies throughout the extent of said undulations.

23. The shoe construction of claim 1 wherein a plurality of undulations are employed and wherein the amplitude of the undulations varies throughout the extent of said undulations.

24. The shoe construction of claim 1 wherein a plurality of girthing straps are employed and wherein each strap is provided with a separate undulating surface which regulates the change in dimensioning for that strap.

25. The shoe construction of claim 24 wherein the direction of each strap is perpendicular to the contour of the respective undulating surface.

26. The shoe construction of claim 24 wherein each of the undulating surfaces has the wavelength and amplitude varied throughout the extent of said undulations.

27. The shoe construction of claim 1 wherein a plurality of girthing straps are emplyed, said girthing straps including anterior and posterior straps on the lateral side of the shoe and anterior and posterior straps on the medial side of the shoe, said anterior lateral strap being positioned along the length of the shoe to overlie and pass posterior to the fifth metatarsal head of the foot, said posterior lateral strap being positioned along the length of the shoe to overlie and pass across the foot proximate and adjacent the calcaneal-cuboid joint of the foot, said anterior medial strap being positioned along the length of the shoe to overlie and be directed posterior to the first metatarsal head of the foot, and with said posterior medial strap being positioned along the length of the shoe to overlie and be directed posteriorly after passing proximate and adjacent the navicular protuberance of the foot.

28. The shoe construction of claim 1 wherein said girthing strap is of a relatively inextensible material.

* * * * *